US005499404A

United States Patent [19]

Marchiorello

[11] Patent Number: 5,499,404

[45] Date of Patent: Mar. 19, 1996

[54] ARTICLE OF MEN'S UNDERWEAR HAVING SHIRRED FRONTAL FLY OPENING

[76] Inventor: Piero Marchiorello, Via Matteotti, 1, 36027 Rosa'

[52] U.S. Cl. ..... 2/403; 2/405; 2/227

[58] Field of Search ..... 2/400, 402–406, 2/408, 227–228, 238, 234, 236, 237, 220, 221, 114, 219, 67; 604/65–70

[56] References Cited

U.S. PATENT DOCUMENTS

| | | | |
|---|---|---|---|
| 1,628,891 | 5/1927 | Lefkowitz | 2/235 |
| 2,085,425 | 6/1937 | Goodwin | 2/406 |
| 2,259,236 | 10/1941 | Wellins et al. | 2/221 |
| 3,774,241 | 11/1973 | Zerkle | 2/406 |

*Primary Examiner*—C. D. Crowder
*Assistant Examiner*—Gloria Hale
*Attorney, Agent, or Firm*—Hoffman, Wasson & Gitler

[57] ABSTRACT

An article of men's underwear having a front aperture bounded by two edges and having a front portion of a waistband with two strips for independently supporting the edges, at least one of the edges is slidable along its respective strip between a position in which the two edges are at least partly superposed and a position in which they are spaced apart.

4 Claims, 1 Drawing Sheet

ARTICLE OF MEN' S UNDERWEAR HAVING SHIRRED FRONTAL FLY OPENING

FIELD OF THE INVENTION

This invention relates to an article of men's underwear.

BACKGROUND OF THE INVENTION

Known articles of men's underwear, of the briefs or boxer shorts type, are generally provided with a front aperture used for satisfying the usual physiological needs without having to completely lower the article of underwear.

DISCUSSION OF PRIOR ART

Two basic types of aperture currently exist, distinguished respectively by having their edges side by side or their edges superposed. In the first case it is preferable, for evident reasons of hygiene and comfort, that said edges be provided with suitable means for retaining them in their side-by-side state, whereas in the second case the fact that they are superposed makes such retention means superfluous.

Apertures with superposed edges have proved rather inconvenient in use, whereas apertures with side-by-side edges do not suffer from this inconvenience if not provided with systems for retaining the edges side by side, however in that case there are obvious hygiene and comfort problems, whereas they are rather complicated to use if provided with retention means whether of zip or button type.

SUMMARY OF THE INVENTION

The main object of the invention is to obviate these drawbacks by providing an article of men's underwear comprising a front aperture bounded by two edges which are superposed only when said aperture is not to be used.

A further object of the invention is to provide an article of men's underwear which can be either of briefs type or of boxer shorts type.

These and further objects which will be apparent from the description given hereinafter are attained according to the invention by an article of men's underwear provided with a front aperture bounded by two edges and characterised by comprising in correspondence with a front portion of the waistband two strips for independently supporting said edges, at least one of which is slidable along its respective strip between a position in which the two edges are at least partly superposed and a position in which they are spaced apart.

BRIEF DESCRIPTION OF THE DRAWINGS

A preferred embodiment of the present invention is described in detail hereinafter with reference to the accompanying drawing, in which.

DESCRIPTION OF THE PREFERRED EMBODIMENT

As can be seen from the figures, the article of underwear according to the invention, in the form of boxer shorts, comprises a front aperture bounded by two superposable edges 2, 2' and is provided with an elastic waistband 4 which in correspondence with said aperture is split into two portions 6, 6', each of which is used for guiding one of said edges 2,2' which can therefore slide along the respective portion of elastic waistband independently of the other edge.

The operation of the article of underwear according to the invention is totally apparent from the description: when the two edges 2, 2' are superposed (see FIG. 1) the boxer shorts are completely closed, as in the case of any other boxer shorts with their aperture bounded by superposed edges. When it becomes necessary to open them, each of the two edges 2, 2' is merely slid along the respective portion of elastic waistband 6, 6' and accommodated to the side of the front aperture which forms in this manner (see FIG. 2).

Figure 1:
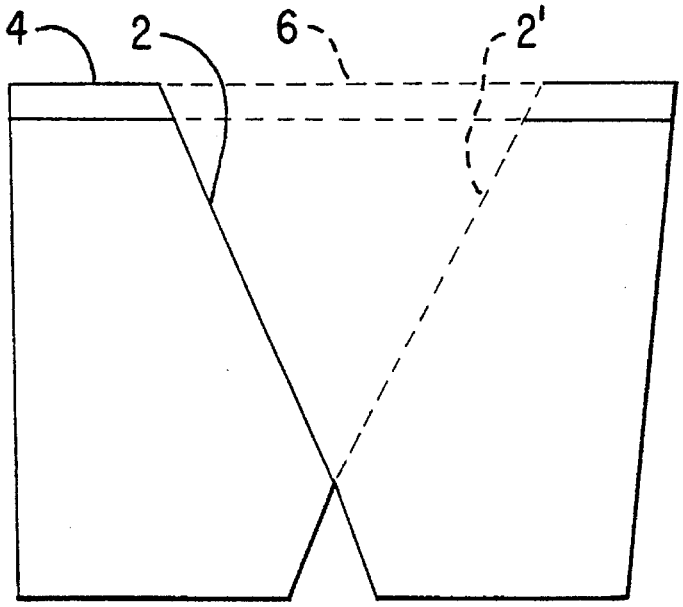
FIG. 1 is a front schematic view of an article of underwear according to the invention in its closed state.
Figure 2:
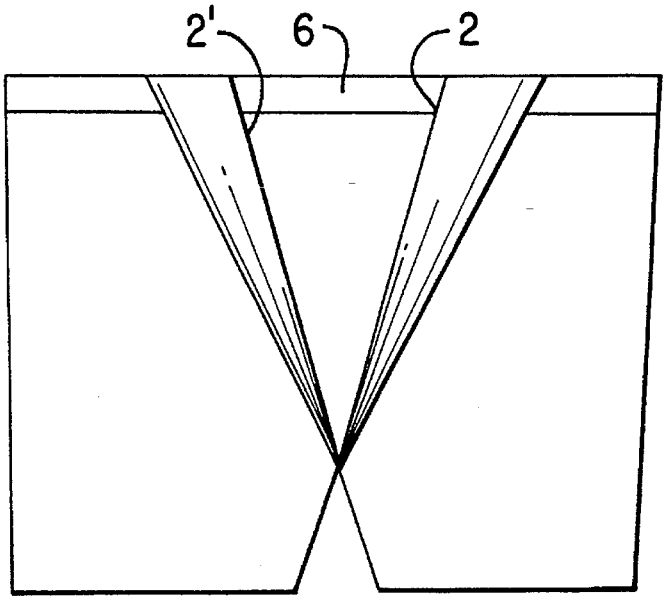
FIG. 2 shows the same view thereof but in its open state.
Figure 3:
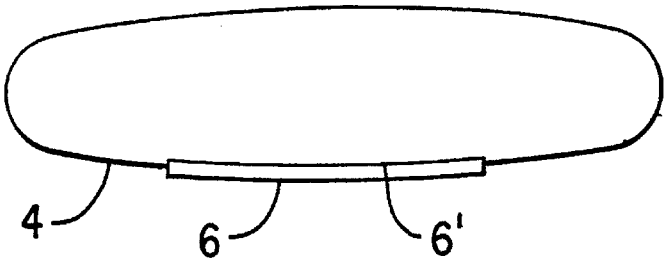
FIG. 3 is a schematic plan view showing the arrangement of the elastic waistband.

To reclose them, each edge 2,2' is merely slid in the reverse direction and returned to the state shown in FIG. 1.

To achieve more regular and easy sliding of each edge 2, 2' the two front guide portions 6, 6' are preferably in the form of non-stretchable strips rather than elastic strips.

Basically, the article of men's underwear according to the invention is considerably more practical than traditional articles of underwear with a front aperture, in that it combines the merits of those having their aperture bounded by superposed edges with those having their aperture bounded by side-by-side edges, while at the same time eliminating their drawbacks.

I claim:

1. An article of underwear having a front aperture bounded by two edges comprising:

a front portion of a waistband having two strips for independently supporting said edges, at least one of said two edges being slidable along its respective strip between a position in which said two edges are at least partly superposed and a position in which said two edges are spaced apart.

2. An article of underwear as claimed in claim 1, wherein both said two edges are slidable along said two strips.

3. An article of underwear as claimed in claim 1, wherein said waistband is formed entirely as an elastic strip.

4. An article of underwear as claimed in claim 1, wherein said waistband is formed as an elastic strip, and has a guide portion for guiding said slidable one of said two edges formed from a non-stretchable strip.

* * * * *